US005494263A

United States Patent [19]

Beckwith et al.

[11] Patent Number: 5,494,263

[45] Date of Patent: Feb. 27, 1996

[54] SYSTEM FOR SOLID MATERIAL CHARGING INTO VERTICAL REACTORS BY ELECTRONIC CONTROL OF THE EXHAUST GASES

[75] Inventors: Carlos A. Beckwith; Carlos M. Beckwith; Francisco J. Barraza, all of Querétaro, Mexico

[73] Assignee: Centro de Investigacion y Asistencia Tecnica del Edo. de Qro, A.C., Queretaro, Mexico

[21] Appl. No.: 206,668

[22] Filed: Mar. 7, 1994

[51] Int. Cl.[6] ..... C21C 5/38

[52] U.S. Cl. ..... 266/80; 266/154; 266/159; 266/199

[58] Field of Search ..... 266/80, 148, 154, 266/159, 199

[56] References Cited

U.S. PATENT DOCUMENTS

| | | | |
|---|---|---|---|
| 3,591,158 | 6/1969 | Pantke et al. | 266/199 |
| 3,679,192 | 7/1972 | Powell | 266/27 |
| 3,693,956 | 9/1972 | Nieboer | 266/27 |
| 3,695,466 | 10/1972 | Sugaware et al. | 214/37 |
| 3,704,992 | 12/1972 | Nieboer | 214/37 |
| 3,706,387 | 12/1972 | Tokarz | 214/37 |
| 3,759,404 | 9/1973 | Mahr | 214/37 |
| 3,780,890 | 12/1973 | Glover | 214/36 |
| 3,788,621 | 1/1974 | Nieboer | 266/27 |
| 3,796,419 | 3/1974 | Werner et al. | 266/27 |
| 3,880,306 | 4/1975 | Grewer et al. | 214/152 |
| 4,001,488 | 1/1977 | Bruff et al. | 13/33 |
| 4,050,592 | 9/1977 | Greaves et al. | 214/18.2 |
| 4,116,345 | 9/1978 | Greaves et al. | 214/37 |
| 4,322,197 | 3/1982 | Mahr et al. | 414/206 |
| 4,544,138 | 10/1985 | Peterseim et al. | 266/154 |
| 4,708,643 | 11/1987 | Nagl et al. | 432/95 |
| 4,728,240 | 3/1988 | Mahr et al. | 414/21 |
| 4,820,105 | 4/1989 | Legille et al. | 414/200 |
| 4,881,869 | 11/1989 | Henneken et al. | 414/786 |
| 4,949,940 | 8/1990 | Weber | 266/100 |
| 5,028,034 | 7/1991 | Bishop et al. | 266/154 |
| 5,046,908 | 9/1991 | Cimenti et al. | 414/203 |
| 5,133,801 | 7/1992 | Saarinen | 75/707 |

*Primary Examiner*—Scott Kastler
*Attorney, Agent, or Firm*—Jacobson, Price, Holman & Stern

[57] ABSTRACT

This invention relates to a method to provide a system for solid material charging into vertical reactors by electronic control of the exhaust gases, a unique process applied for charging into vertical reactors, cupolas, ferrous and non-ferrous blast furnaces, and shaft furnaces in the absence of the use of conventional flap valves, pressure chambers, doors or bells to prevent the exhaust gases from escaping uncontrolled to the atmosphere. In this invention, the solid charging materials are loaded at all times into the reactor through the charge duct without loss of exhaust to the atmosphere or air infiltration into the exhaust gases. A controlled post combustion is conducted when the exhaust gases contain substantial amount of combustible gases. An adjustable-high-temperature-air blast is used for reduced fuel costs. The heat of exhaust gases is transferred to the air and the waste gases are exhausted at low temperature.

7 Claims, 10 Drawing Sheets

SYSTEM FOR SOLID MATERIAL CHARGING INTO VERTICAL REACTORS BY ELECTRONIC CONTROL OF THE EXHAUST GASES

BACKGROUND OF THE INVENTION

1. Field of the Invention

This invention relates to a novel charging system for solid materials into vertical reactors such as vertical ovens, chemical reactors, cupolas, ferrous and non-ferrous blast furnaces, shaft furnaces, chemical reactors and the like without the use of locks, conventional flap valves, gates, pressure chambers, doors or bells but by means of electronic control of the exhaust gases.

2. Description of Prior Art

Previous art for charging systems for vertical metallurgical and chemical reactors and furnaces is very extensive.

In order to provide background information so that the invention may be completely understood and appreciated in its proper context, reference may be made to a number of prior patents and publications as follows:

U.S. Pat. No. 5,133,801 to Saarinen, relates to a method and apparatus for feeding solid material into a smelting furnace, particularly into the top part of the reaction space of a smelting furnace. The solid material is supplied through a feed gate to the reaction space.

U.S. Pat. No. 5,046,908 to Cimenti is directed to a deflecting plate within the hopper, said plate having a closed position for closing the bottom end of the hopper and said plate being movable vertically upwardly from the closed position to define an annular orifice at the bottom end of the hopper and means for moving the deflecting plate vertically within the hopper.

U.S. Pat. No. 4,949,940 to Webber concerns a separating wall into a lower distributor chamber and an upper lock chamber to which the charging material can be fed from above through a filling hopper. Outside its middle and distributed around its periphery, the separating wall includes at least two individually closable bottom openings through which the charging material can be passed from the lock chamber into the distributor chamber. The charging material is fed to the shaft furnace through distributor pipes which connects the distributor chamber to the shaft furnace.

U.S. Pat. No. 4,881,869 to Henneken involves a furnace wherein while a material is being charged in the upper hopper, one of the charging valves is open and the bellows is pressureless. During, or shortly after the charging, the upper hopper is rotated. For filling the lower hopper, the valves of the upper hopper are closed, bellows is inflated, and the upper sluice chamber is pressurized.

U.S. Pat. No. 4,820,105 to Legile provides two containers mounted there above provided with sealing valves and a metering member.

U.S. Pat. No. 4,728,240 to Bernard wherein above the chamber are arranged at least two locks which are each provided with upper and lower sealing flaps. Preferably, the storage hopper and the bottom of each of the locks are in the configuration of tapered funnels.

U.S. Pat. No. 4,708,643 to Fugger discloses a feed container designed to constitute a lock chamber, which is provided with a shut-off valve for controlling the inlet port of the feed container and with a plurality of shut-off valves for controlling respective outlet ports connected to the charging ducts.

U.S. Pat. No. 4,322,197 to Wurth involves a material to be deposited on the hearth of a shaft furnace serially passes through a pair of temporary storage containers positioned above the furnace. The uppermost storage container is in the form of a bin open to the ambient atmosphere while the lower storage container is provided with valves at either end whereby it may be hermetically sealed and subsequently brought to furnace pressure. The lower storage container is loaded while at ambient pressure, by releasing furnace charge material previously delivered to the upper storage container into the lower container and subsequently by delivering material directly to the lower container from a conveyor system through the lower container. The upper container is refilled with material while the lower container is at furnace pressure and is discharging its contents into the furnace.

U.S. Pat. No. 4,116,345 to Greaves is directed to an apparatus which includes a gas lock means for introducing charge material into the furnace while the furnace is under gas pressure, and a distributor means below the gas lock means that causes the charge material to be deposited and distributed in the upper portion or throat of the furnace either toward the outer periphery of the cross section in the furnace bounded by the interior surface of the furnace wall or toward the center of such cross section, or in both places, to provide an upper surface or stockline or charge material that is essentially level or of any other desired shape within substantial limits. One form of distributor means disclosed comprises a vertically movable distributor bell with an upwardly and inwardly converging top surface that is positioned with the lower edge of such surface positioned either above or below the bottom edge of an opening, larger than the bell diameter, in a distributor hopper with upwardly outwardly diverging sides, so that the material charged into the hopper through the gas lock means can by cooperation of the bell and hopper be deflected either toward the outer periphery or toward the center of the cross section within the furnace or toward any intermediate location, by disclosed positioning or movement of the bell.

U.S. Pat. No. to 4,050,592 to Greaves relates to the bottom edge of an opening, larger than the bell diameter, in a distributor hopper with upwardly outwardly diverging sides, so that the material charged into the hopper through the gas lock means can by cooperation of the bell and hopper be deflected.

U.S. Pat. No. 4,001,488 to Bruff involves a feed chute, i.e., a valve associated with each said charging chute towards the first end thereof, each said valve being operative.

U.S. Pat. No. 3,880,306 to Grewer discloses a pellet feed which is stopped and the input is blocked by a pivotal bell. The bottom of the bucket which is formed by another linearly displaceable but pivotally suspended bell, is then displaced downwardly away from the sides of the bucket and a bell temporarily blocking the outlet is also moved downwardly to allow the mass of pellets in the bucket to spill out and down into the furnace. The bells, thus form alternatively effective inlet and outlet gates sealing the head of the furnace against the escape of gas.

U.S. Pat. No. 3,796,419 to Roenick relates mounted on the upper portion of the furnace portion, above two furnace bells in superposed stationary hoppers. Each of the port means has an upwardly open mouth, and individual valve means for closing the port means gas tight and for opening the port means independently of other port means so it can provide an unimpeded flow of material into the furnace.

U.S. Pat. No. 3,788,621 to Nieboer involves a valve which includes an annular sealing lip which engages into a seat defined on the exterior of the hopper around the exterior of the bell and engages with the seat at a location above the sealing seat defined at the interior of the hopper and which is engaged by the small bell. The small bell dams the material at the outlet of the hopper and a lower larger bell provides a distribution for the material and is located within the furnace below the small bell.

U.S. Pat. No. 3,780,890 to Glover concerns several individual port means which are spaced around the axis and mounted on the upper portion of the furnace above two superposed furnace bells in superposed stationary hoppers. Each of the port means has an upwardly open mouth, and individual valve means for closing the port means gas tight and for opening it independently of other port means so it can provide a flow of material into the furnace.

U.S. Pat. No. 3,759,404 to Mahr is directed to a charging device for a shaft furnace, comprising an upper chamber, a lower chamber communicating with the upper chamber, an upper charging bell in the upper charging chamber, and a lower charging bell below the lower chamber.

U.S. Pat. No. 3,796,387 to Tokarz relates to an apparatus including a revolving multi-chamber distributor hopper with swing valves to define a gas seal below the distributor hopper and material gates to prevent discharge of material on to the swing valves.

U.S. Pat. No. 3,704,992 to Nieboer involves having a top pan with a distributor bell therein which is movable upwardly to close the top pan to permit an accumulation of charging material thereover and which may be moved downwardly to provide an annular charging opening for the material to drop off the bell into the furnace.

U.S. Pat. No. 3,695,466 to Sugawara pertains to an apparatus for charging raw materials or ore rocks into a furnace, and uses four bells namely a large bell, a middle bell, a small bell and a rotating hopper bell serving as the charging apparatus for the furnace, and these bells are formed so as to provide sealing and charging or distributing functions and each of them is suitably operated to smoothly charge raw materials.

U.S. Pat. No. 3,693,956 to Nieboer relates to a charging device for a metallurgical furnace includes a hopper and a bell assembly which are positionable in a furnace head. The hopper is pivotally mounted below a storage bin and it may be oriented by push rods to drop the charged material in any desired direction. A distributor bell is mounted within the furnace head on supporting rods in a position such that the outer periphery thereof may be engaged with a top pan portion of the furnace to provide a seal for preventing the further down flow of the charging material but not for the purpose of providing a pressure gas seal.

U.S. Pat. No. 3,679,192 to Powell is directed to an improvement in a bell and bell hopper top charging device for use with a blast furnace comprises a retaining surface that projects upwardly from a frusto-conical surface of the bell to form a pocket between the frusto-conical surface and the retaining surface. This pocket is filled with raw materials. Upon lowering the bell from the bell hopper to discharge the raw materials from the bell hopper, the raw materials flow over the retained material in the pocket and out of contact with the sealing surface of the bell. The improvement further comprises a supplemental sealing means that is mounted to the bell hopper for engagement with the sealing surface of the bell for maintaining a gastight seal between the bell and the bell hopper.

Whatever the precise merits, features and advantages of the above cited references, none of them achieves or fulfills the purposes of the process described in this invention. The previous art for charging solid materials in vertical reactors, furnaces, and at the same time to prevent the exhaust gases from escaping to the atmosphere, has traditionally used locks, conventional flap valves, gates, pressure chambers, doors or bells, as can be seen by reading the previous references. The mentioned devices, have a high initial cost and extensive maintenance due to the temperature and the corrosion that they are exposed. The invention provides a unique simple process, to eliminate the previous disadvantages, by means of a bellow-charge-gas-off-take, measuring a gas flow and by electronically controlling of the exhaust gases by a servo valve, after the gases are cooled and cleaned. With this invention, it is possible to load solid charge materials at all times, into the reactor without loss of gases to the atmosphere or the intake of air into the gases.

SUMMARY OF THE INVENTION

This invention pertains to a method to provide a system for solid material charging into vertical reactors by electronic control of the exhaust gases, a unique process applied for charging into vertical reactors, ovens, chemical reactors, cupolas, ferrous and non-ferrous blast furnaces and shaft furnaces, without the use of conventional flap valves, pressure chambers, doors or bells to prevent the exhaust gases from escaping uncontrolled to the atmosphere. In this invention, the naturally variable volume production of exhaust gases, are prevented from escaping uncontrolled, while the reactor is being charged with solid materials, due to a unique method of electronically controlling the exhaust gases comprising of a vertical reactor, a refractory-lined-water-cooled-charge-duct of smaller diameter than the reactor, built within and above the reactor, forming a concentric inlet; the steel shell of the plenum surrounds and supports said concentric inlet and forms the bellow-charge-gas-off-take for the hot gases. Within the plenum, a settling chamber is formed, where the coarse particles are settled and deposited in a plurality of outside containers. The hot gases after being cleaned, are exhausted through the plenum-outlet duct, to a gas-to-gas heat exchanger, in which the heat of the hot exhaust gases is transferred to the combustion air of the reactor, thus saving fuel. The cooled exhaust gases after passing through the heat-exchanger, pass to a conventional cleaning system where the gases are further cooled and cleaned and exhausted to the atmosphere. In series with the path of said exhaust gases, from the plenum-outlet to the atmospheric discharge, a servo valve is placed in series with a suction fan which are installed after a heat exchanger in order to reduce maintenance by avoiding heat and particles. The exhaust fan, is modulated by the servo valve, supplies the necessary energy to drive the exhaust gases to follow the route described instead of exhausting through said refractory-lined-water-cooled-charge-duct.

The suction delivered from the fan and servo valve, is controlled by an electronic controller connected to a differential-pressure-sensor, between a pressure-control-point in the refractory-lined-water-cooled-charge-duct just above the hot gas off-take, and the reference-pressure-control-point at the atmospheric end of the refractory-lined-water-cooled-charge-duct. The electronic controller and associated sensor, measures the difference in static pressure of the control-points in the charge-duct, and compares it with the calibration-set-point and delivers either a positive or negative DC voltage to open or close the servo valve, which controls the gas flow from the process. When the differential pressure is electronically held close to zero between the control-points at the charge duct in all operating conditions, the gas or air flow in the charge-duct will also be maintained close to zero. Hence, the offset is adjusted to prevent gases from escaping to the atmosphere and at the same time, preventing air infiltration into the gases.

A more specific feature resides in that it is possible to load solid charge materials at all times into the reactor through the refractory-lined-water-cooled-charge-duct, which should preferably be kept full of solid charge material, and that while loading, there will be no loss of exhaust gases to the atmosphere nor intake of air into the said exhaust gases.

An alternative embodiment of the described invention is when the exhaust gases contain substantial amounts of combustible gases such as carbon monoxide, hydrogen, hydrocarbon or mixtures thereof, the method permits controlled post combustion, while the gases are still hot, which results in an increase of the temperature of the combusted gases before said gases are introduced into the heat exchanger, obtaining an adjustable-high-temperature-air-blast for a more efficient combustion in the reactor, thus, further reducing costs and decreasing pollution.

The proportional-electronic-control is used to override said electronic-differential-pressure-transmitter, by an electronic-temperature-transmitter connected to a temperature-sensor for measuring the temperature, located in the exhaust duct before the heat exchanger.

BRIEF DESCRIPTION OF THE DRAWINGS

For a fuller understanding of the nature and objects of the present invention, reference is made to the following description of the preferred embodiments which is to be taken in connection with the accompanying drawings, wherein.

DESCRIPTION OF THE PREFERRED EMBODIMENTS

Figure 1:
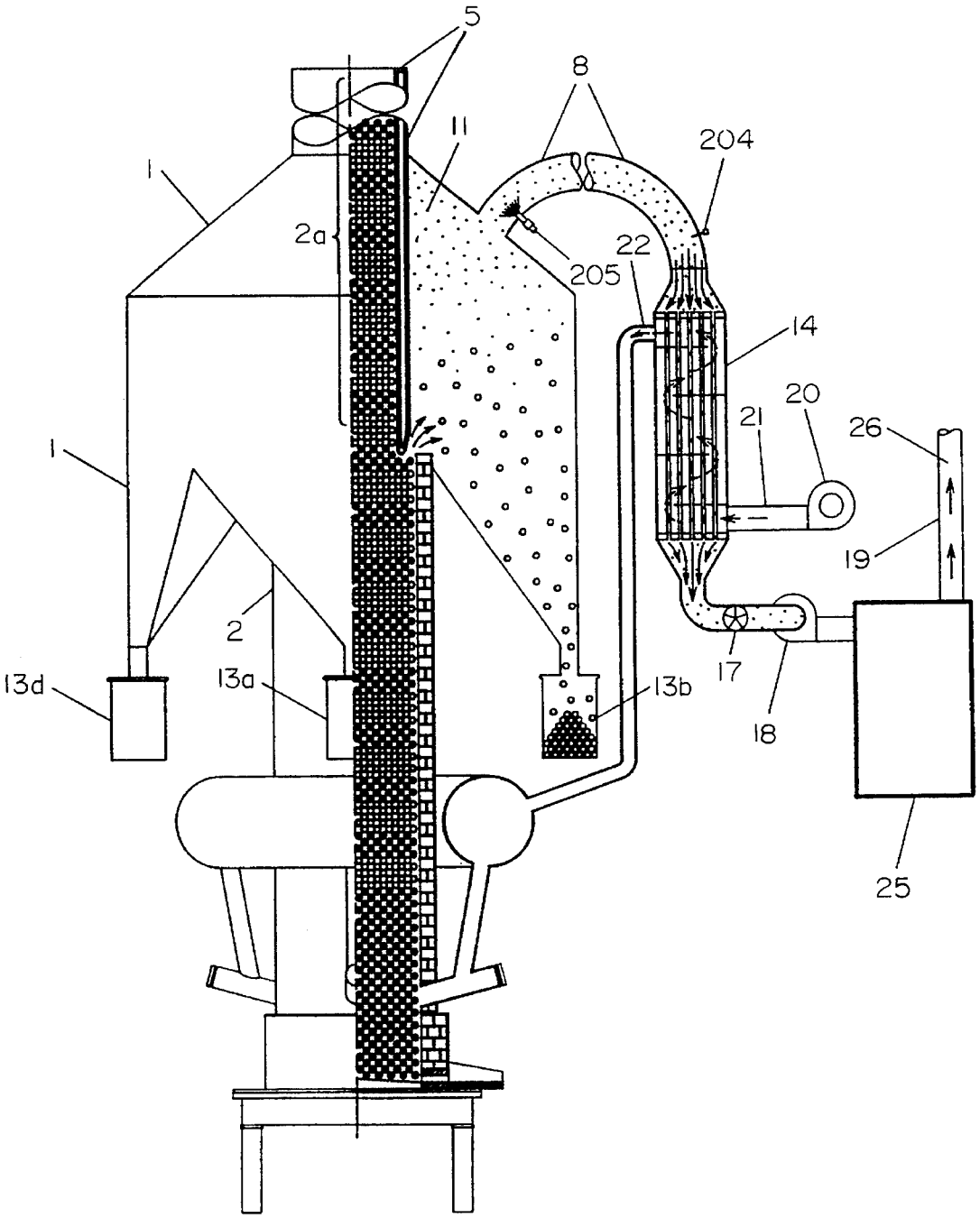
FIG. 1 is a partial medial cross sectional view illustrating a typical method in accordance with the present invention.
Figure 2A:
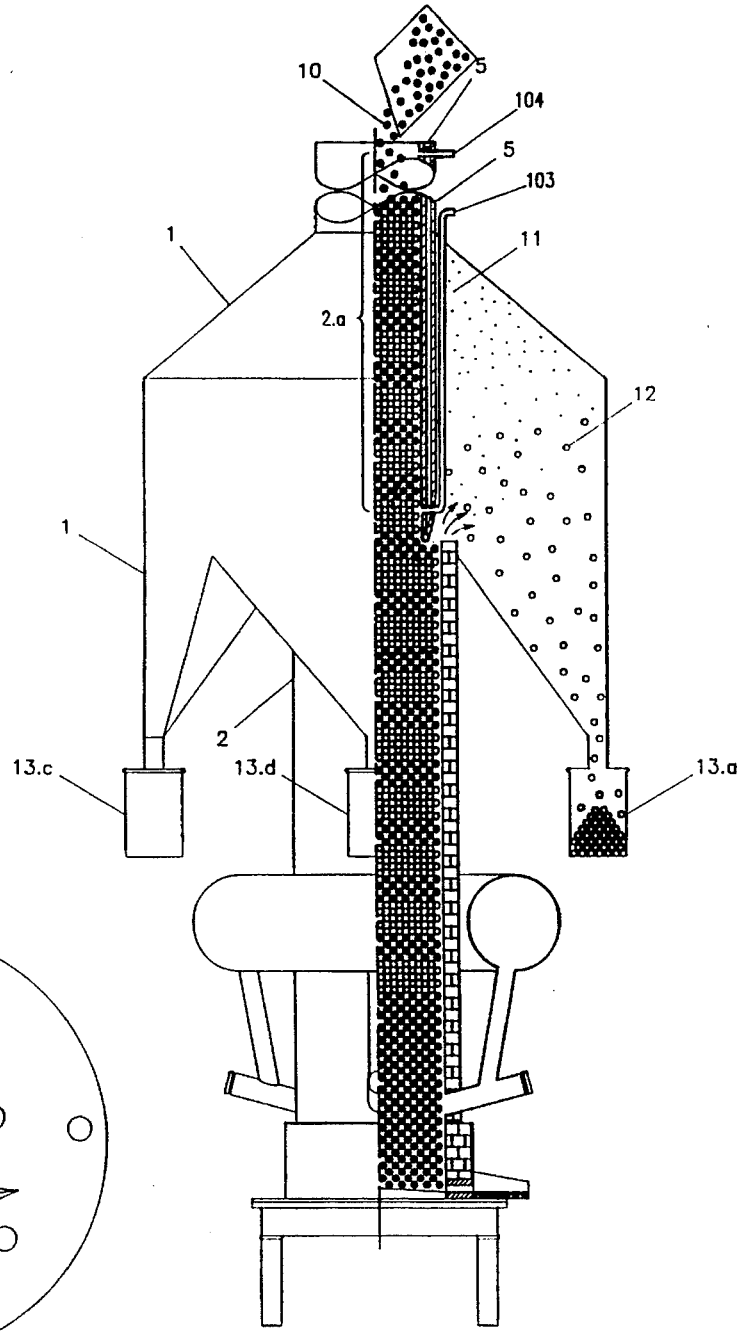
FIG. 2*a* is a partial medial cross sectional side view illustrating a typical method in accordance with the present invention.
Figure 2B:
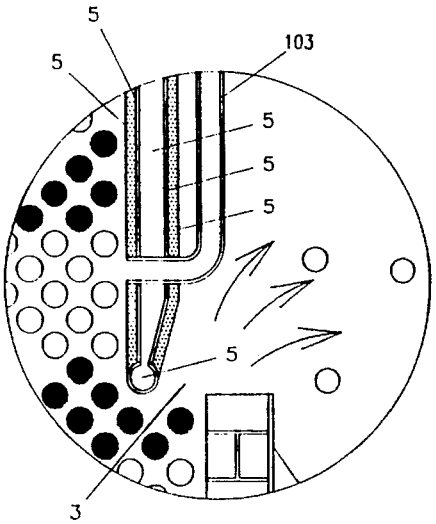
FIG. 2*b* is a medial cross section of the refractory-lined-water-cooled-charge-duct.
Figure 3:
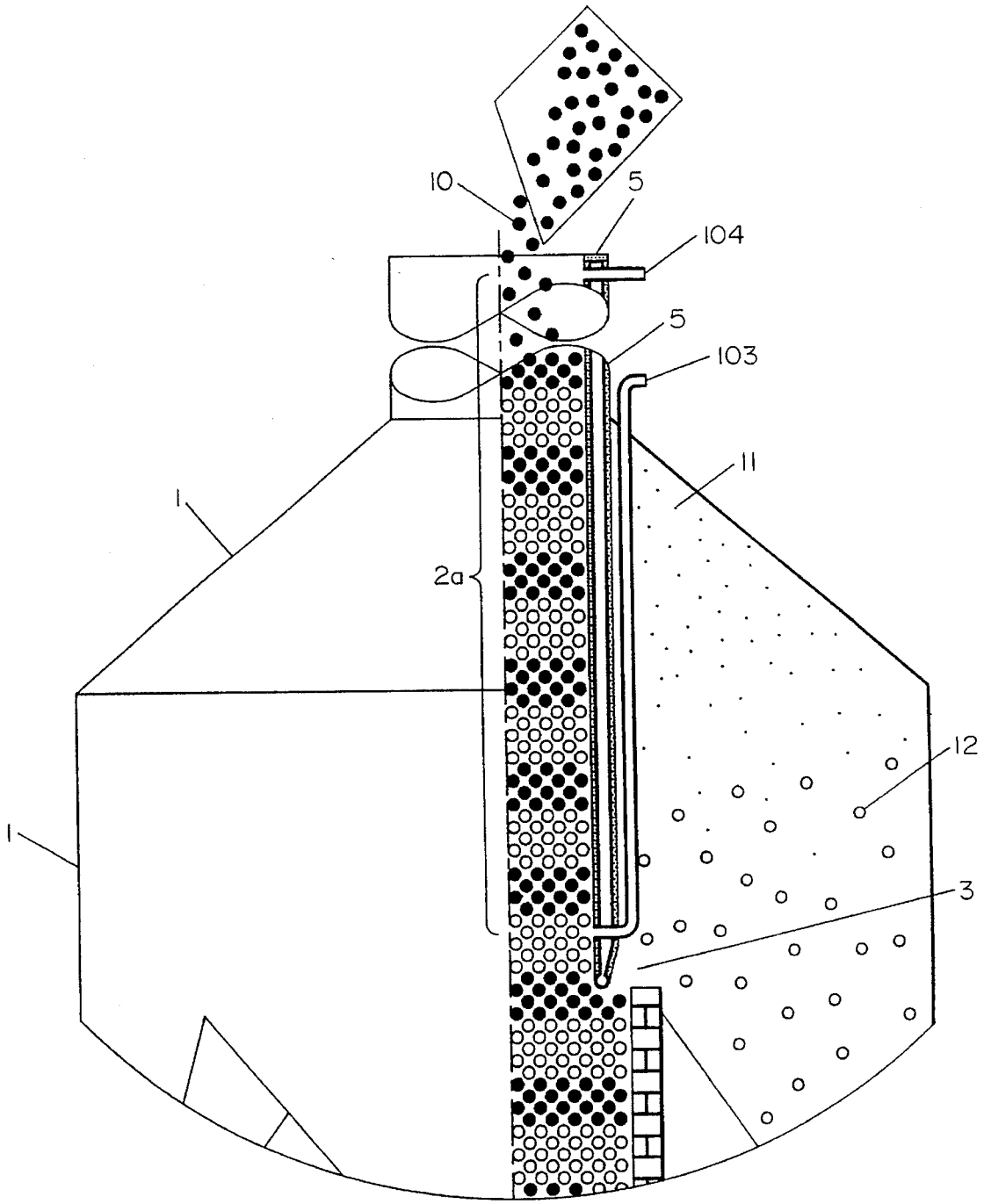
FIG. 3 is an enlargement of part of FIG. 2.

The principal object of this invention is to provide a method for solid materials charging into vertical reactors by electronic control of the exhaust gases, a unique process applied for charging into vertical reactors, ovens, chemical reactors, cupolas, ferrous and non-ferrous blast furnaces, and shaft furnaces, without the use of conventional flap valves, pressure chambers, doors or bells to prevent the exhaust gases from escaping uncontrolled to the atmosphere. In this invention, the naturally variable volume production of exhaust gases is prevented from escaping uncontrolled while the reactor is being charged with solid materials, due to a unique method of electronically controlling the exhaust gases.

Referring now specifically to FIG. 1, 2*a*, 2*b* and 3 where the preferred embodiment of the method is illustrated as applied in this instance to a cupola, comprises, a vertical reactor 2, a refractory-lined-water-cooled-charge-duct 5 of smaller diameter than the reactor 2, built within and above the reactor 2 forming a concentric-inlet 3, the steel shell of the plenum 1 surrounds and supports the concentric-inlet 3 and forms the bellow-charge-gas-off-take for the hot gases. Within the plenum 1 a settling-chamber 11, is formed by plenum 1, steel outer shell 4 and the water-cooled-charge-duct. In the settling-chamber 11, is where the coarse particles are settled and deposited in outside containers 13*a*, 13*b*, 13*c* and 13*d*. The exhaust gases after being cleaned, are exhausted through the plenum-outlet-duct 8 to transfer the sensible heat of said gases to the air combustion by means of a gas-to-gas-heat exchanger 14, in which the heat of the exhaust gases is transferred to the combustion's air for the reactor 2, thus saving fuel. The cooled exhaust gases, pass through a servo valve 17, into the intake of a suction fan 18, that supplies the energy necessary to force said hot dirty exhaust gases to follow the route described, to deliver them to a conventional particulate cleaning system 25 where the gases are further cleaned 26, before the atmospheric-discharge-duct 19.

Referring to FIG. 1. In the air circuit an air pressure fan 20 is connected by duct 21 to the air inlet of gas-to-gas-heat-exchanger 14, in which, the heat of the hot gases is transferred to said air cooling the hot gases and heating said combustion air for the reactor 2, which exits said heat exchanger through the hot-air-blast-outlet 22, a hot-air-blast is delivered to the reactor for combustion at a higher temperature, for lower fuel cost.

Further referring to FIG. 1 in series with the path of the gases, from the plenum-outlet-duct 8 to the atmospheric discharge 19, a servo-valve 17 and a suction fan 18 are placed after the heat exchanger 14 in order to reduce maintenance by avoiding heat and particles. The said exhaust fan is modulated by the servo-valve 17, supplies the necessary energy to force the dirty gases to follow the route described, instead of exhausting through said refractory-lined-water-cooled-charge-duct 5.

Figure 4A:
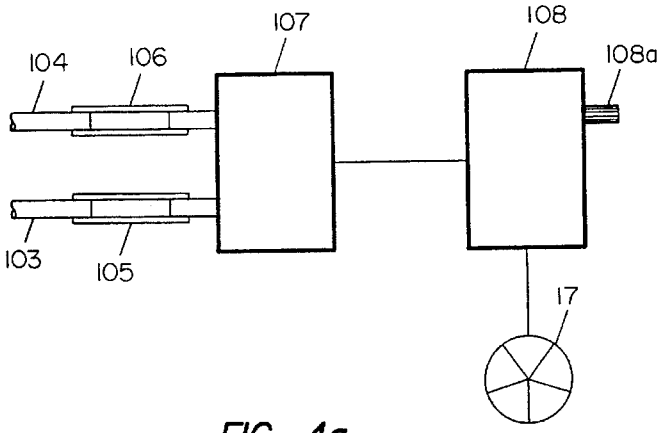
FIG. 4*a* is a block diagram of the pressure electronic control.

A further reference should be made to FIG. 4*a*. In this invention, when the process, changes to a different operating condition, said change is sensed by measuring the difference in static pressures, between a pressure-control-point 103, located in the refractory-lined-water-cooled-charge duct 5 just above the concentric inlet 3 and the reference-pressure-control-point 104 at the atmosphere's end of the charge duct 5. This is achieved by connecting said pressure-control-points 103 and 104 with tubing lines 105 and 106 to an electronic-differential-pressure-sensor-transmitter 107, where the difference in static pressure is changed to a standard 4 to 20 mA proportional current signal which is the input to the proportional-electronic-controller 108, which in turn compares said input with the calibration set point 108*a* and delivers either a positive or negative DC voltage to open or close said servo valve 17, which controls the gas flow from the process by modulating the suction fan 18. If the static pressure-control-point 103 is different than the reference-pressure-control-point 104, the servo valve 17 will begin to move in the correct direction, until the pressures are equal, when the differential static pressure is electronically maintained close to zero between the control points 103 and 104 at the charge duct 5 in all operating conditions, the gas or air flow in the charge duct will also be maintained close to zero. Hence, the offset 108*a* is adjusted to prevent exhaust gases from escaping to the atmosphere and at the same time, preventing air infiltration into the gases. It is possible to load at all times solid charge materials 10 into the reactor 2 through the charge-duct 5 which should preferably be kept full of solid material 10. While charging, there will be no loss of gases to the atmosphere nor intake of air into the gases, since a non-flow condition of gases is maintained in the charge duct 5 in all operating conditions. It is then possible to load at all times solid charge materials 10 into the reactor 2. This invention provides a unique simple process, by electronically controlling the exhaust gases of a vertical reactor 2 by a servo valve 17 and a suction fan 18, placed after the gases have been cooled and cleaned, in order to assure practically no maintenance.

Figure 4B:
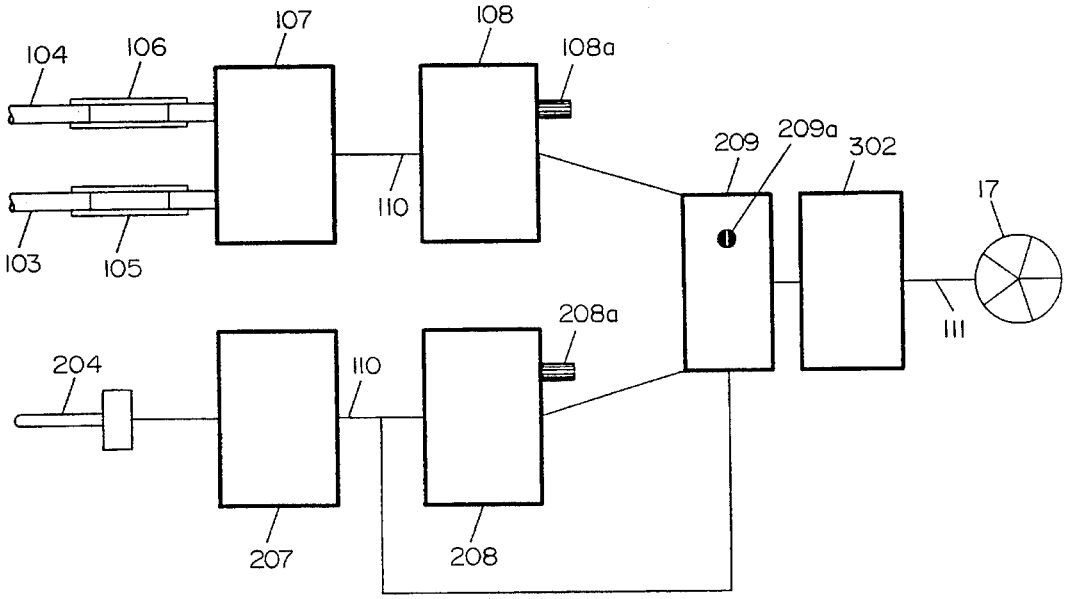
FIG. 4*b* is a block diagram of the electronic control with pressure and temperature controls.
Figure 5:
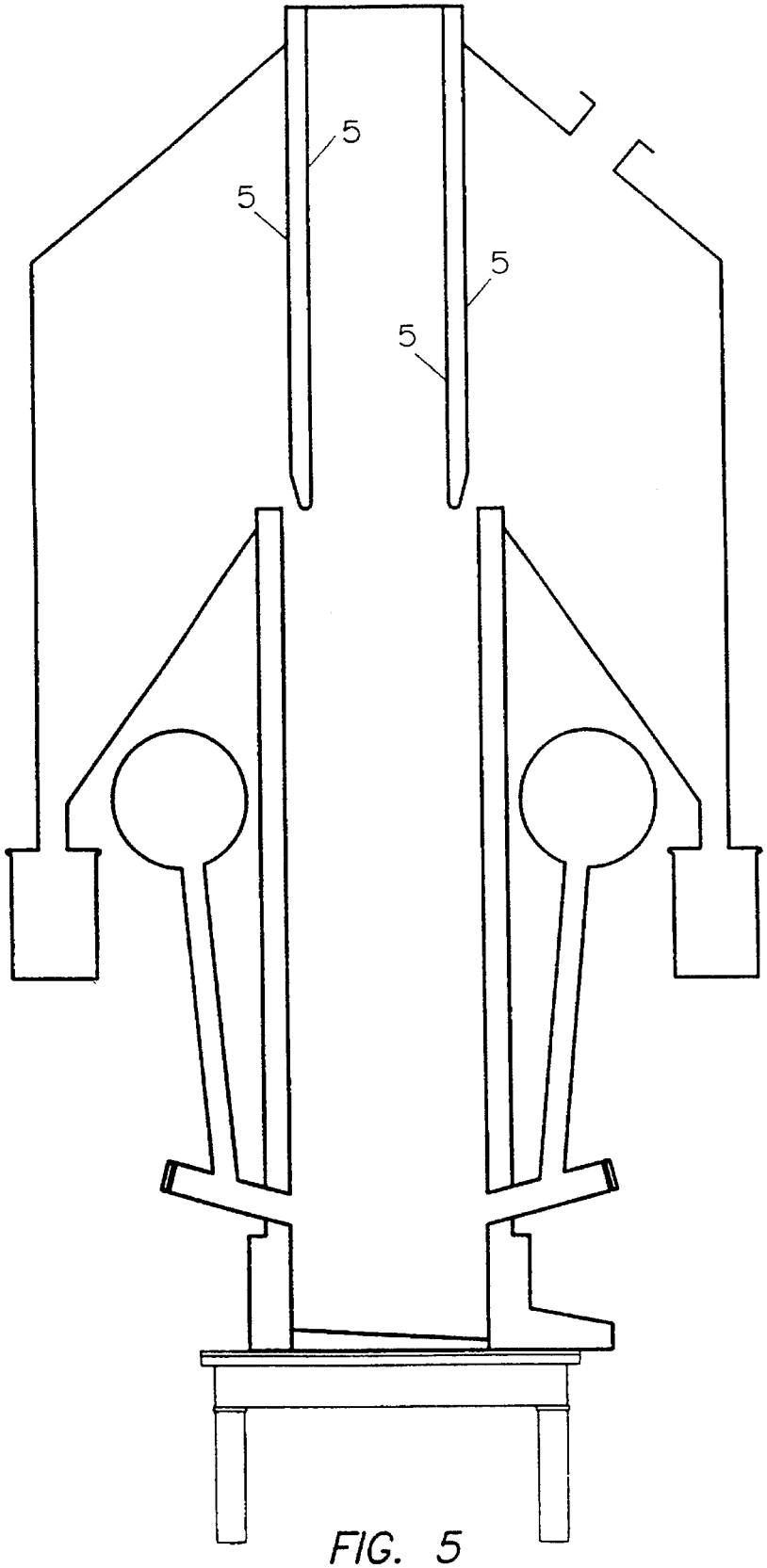
FIG. 5 is a simplified outline of a medial cross section of the inside of the reactor of the preferred embodiment of FIG. 1.
Figure 6:
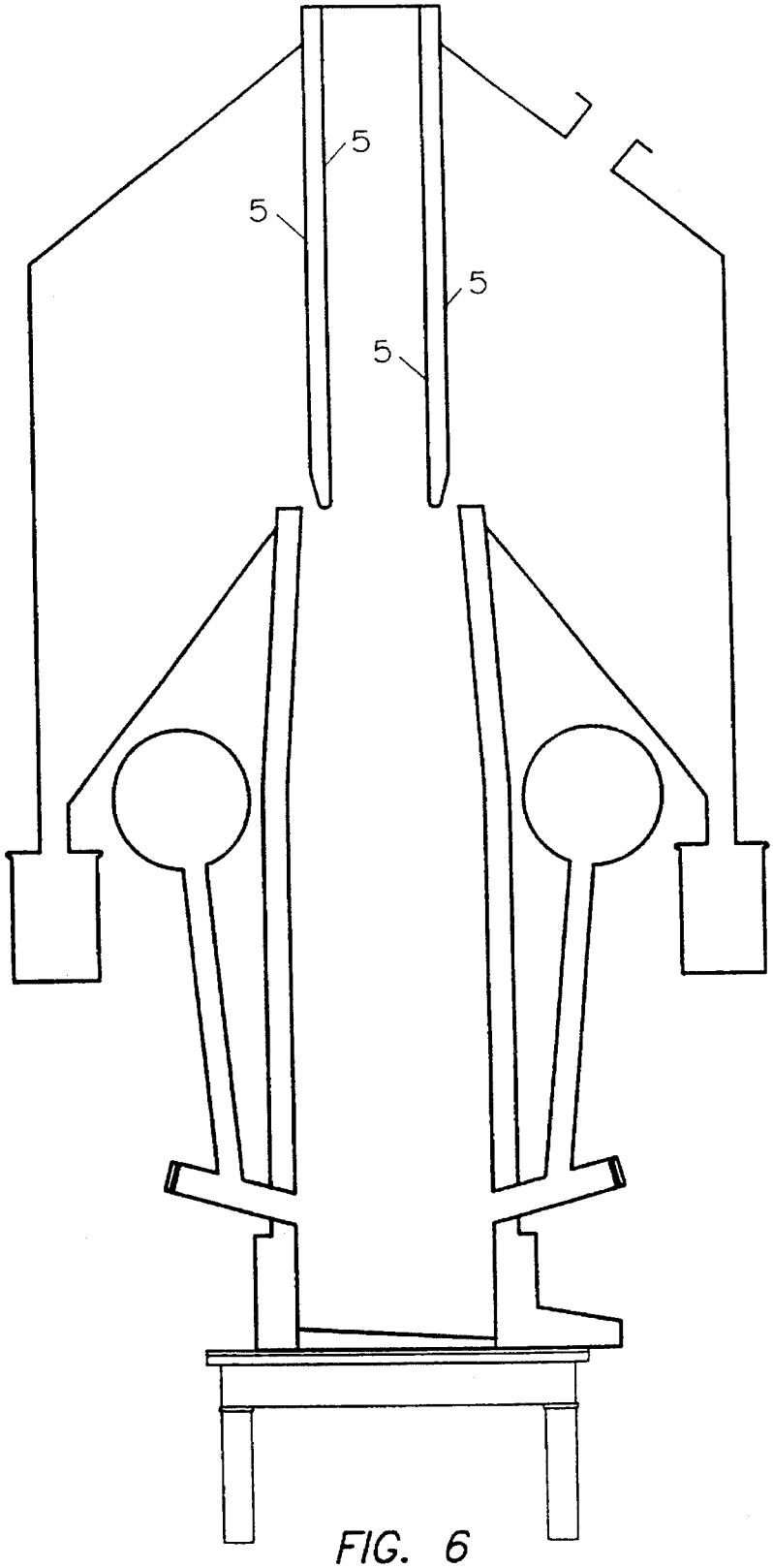
FIGS. 6, 7, 8, 9 and 10 are simplified outline drawings similar to FIG. 5, but with increased pressure drop.
Figure 7:
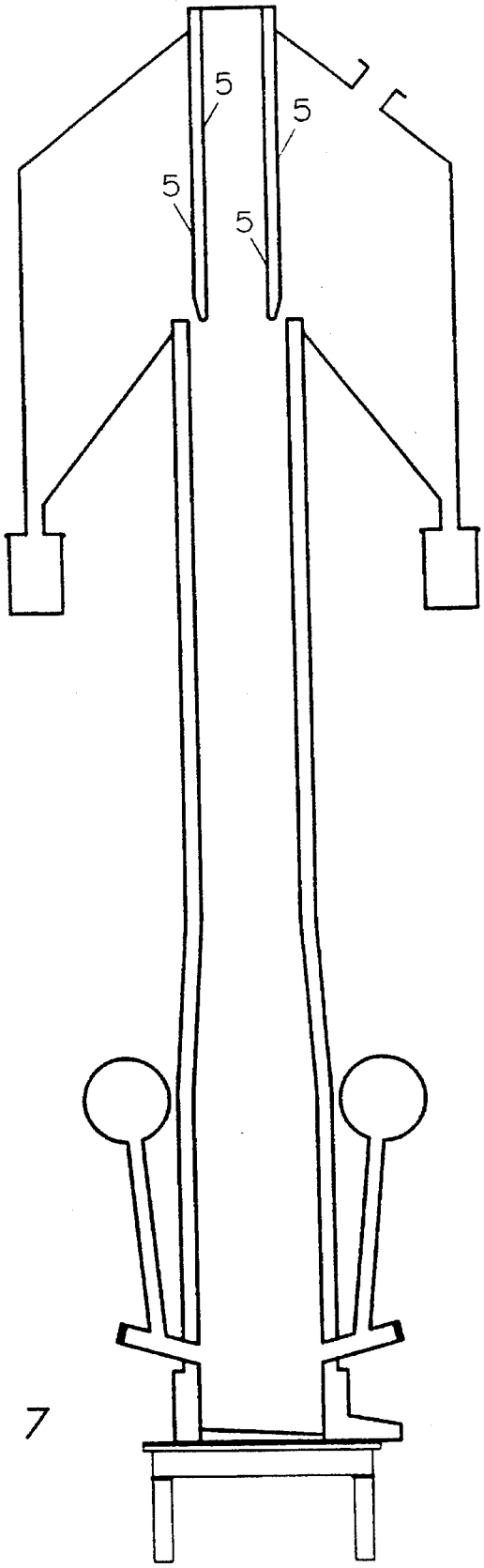
Figure 8:
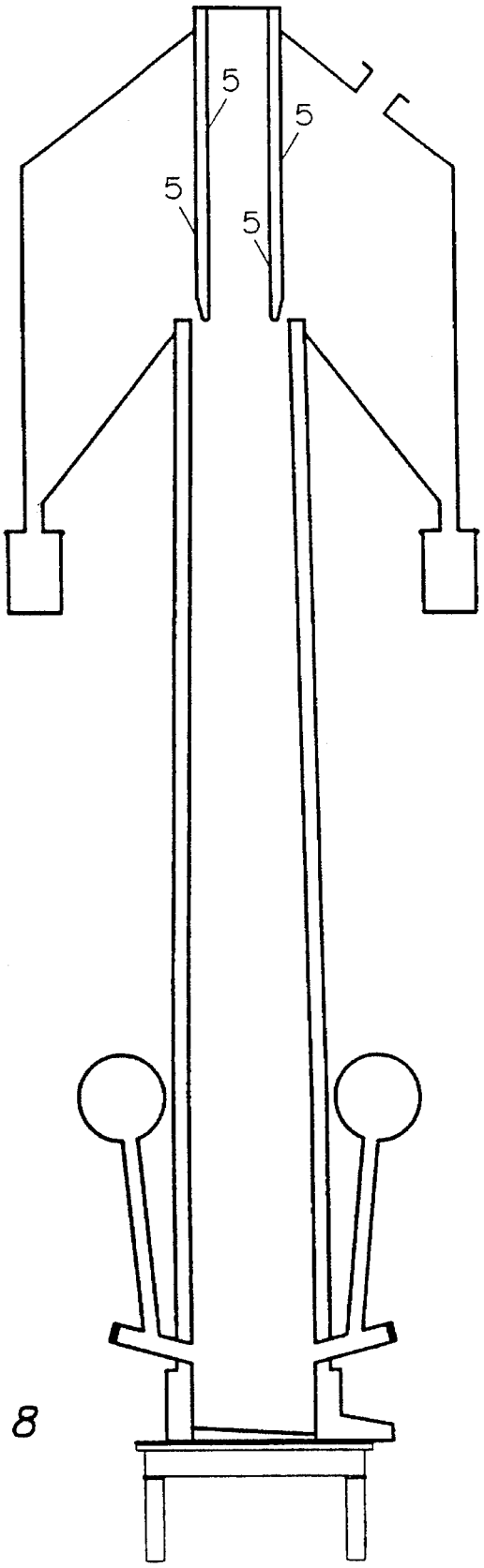
Figure 9:
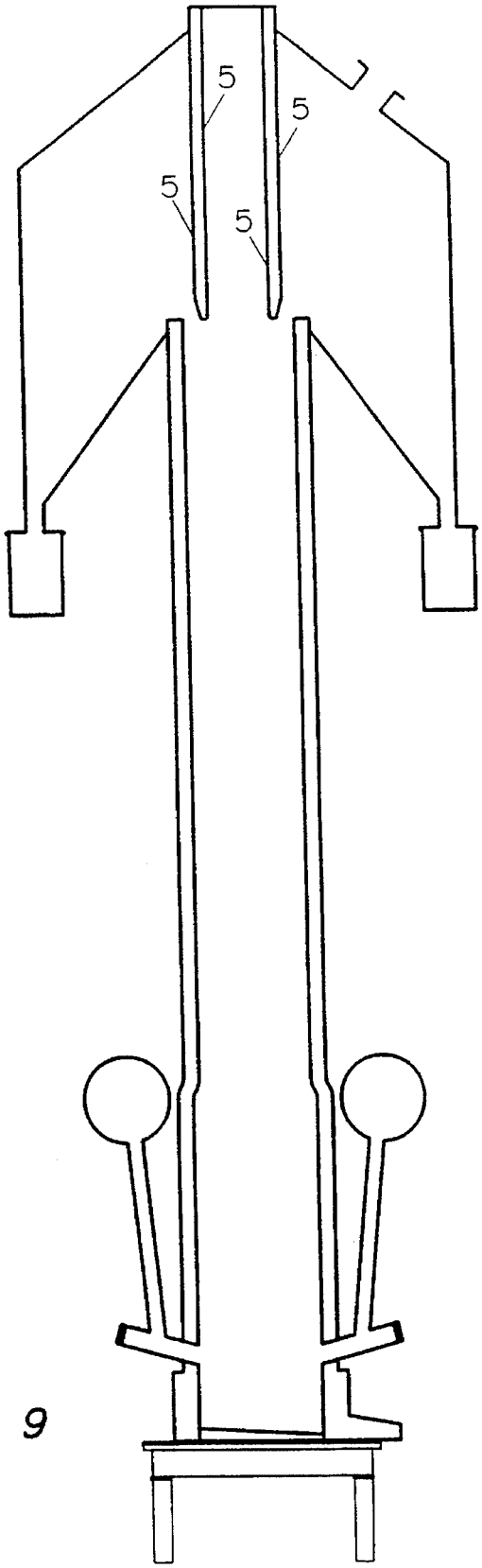
Figure 10:
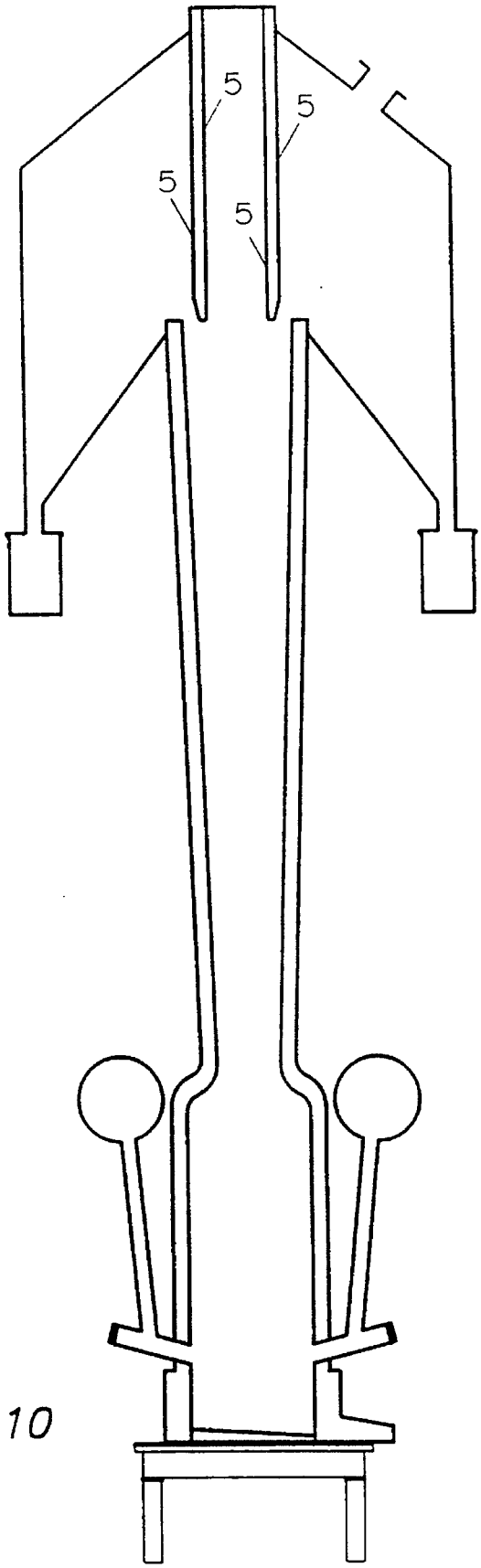

Still further reference should be made to FIG. 1 and 4*b*. An alternative method of the described invention is when the exhaust gases contain substantial amount of combustible gases such as carbon monoxide, hydrogen, hydrocarbon and mixtures thereof, wherein the inducement of a controlled post combustion by permitting a controlled air infiltration into the exhaust gases, while they are still hot and in presence of a flame, which are combusted before the products of combustion are introduced into the heat exchanger 14, results in an increase in the temperature and a decrease of the time means for obtaining an adjustable high-temperature-air-blast 22, for the combustion in the cupola, not only by the use of the sensible heat but using also the latent heat, of the exhaust gases, i.e., transferring the heat of the exhaust gases to the combustion's air by the gas-to-gas-heat-exchanger 14 as previously explained but also transferring in the heat exchanger, the heat of combustion of the combustible gases present in the exhaust gases thus further reducing costs and decreasing pollution. When the operation starts, the method comprises a servo-valve 17, which is controlled by the proportional-pressure control 108, a pilot burner 205 which is always lit at the inlet of the plenum-outlet-duct 8 that connects the plenum 1 to the heat exchanger 14, and where the controlled post combustion takes place. A temperature sensor 204 is placed at the other end of plenum-outlet-duct 8, close to the heat exchanger 14. The signal from the temperature sensor 204, is sent to the temperature-transmitter 207, where it is transformed to a 4–20 mA standard signal, which is then received by the temperature proportional-control 208 by means of an adjustable set-point 208*a* such that when the temperature is within a range of from 100° C. to 500° C., it will override the pressure-proportional-control 108 by means of the priority-selector 209 which has a range adjustment 209*a* from 400° C. to 800° C. The priority selector 209 controls the working temperature of the heat exchanger 14, by sending a signal to the servo-valve-controller 302, where it is then transferred to the servo-valve 17. The servo-valve begins to open, letting air in, to start a post combustion by the reaction between the air and the combustible gases, wherein the temperature is controlled by allowing more or less air infiltration into the combustible gases to combust them, in order to maintain the temperature of the gases at the set points chosen previously. The preceding action will permit an increased energy efficiency, improved air quality and reduced operational cost for the cupola.

What is claimed is:

1. A method for solid material charging into reactors and preventing the escape of exhaust gases uncontrollably into the atmosphere by electronic control of the exhaust gases using a device assembly comprising:

a reactor;

a refractory-lined water-cooled-charge duct having a smaller diameter than the reactor; said charge duct located within and above the reactor;

a plenum, the steel outer shell of which surrounds and supports the concentric inlet; said inlet connecting the reactor with the plenum;

a settling chamber, located within the plenum for settling the coarse solid particulate that are fluidizied within the reactor by the exhaust gases and depositing the coarse particulate in a plurality of outside containers;

a plenum-outlet-duct, provided downstream of the settling chamber;

a gas-to-gas-heat-exchanger, located downstream of the plenum-outlet duct; said heat exchanger connected downstream by a duct to a servo-valve provided downstream of said servo-valve.

a suction fan, modulated by the servo valve for supplying the necessary energy to force the exhaust gas to follow the gas route instead of exhausting through the charge duct; the servo valve and suction fan, are in series with the path of exhaust gases from said concentric inlet to the atmospheric discharge after the heat exchanger;

an air pressure fan, connected by a duct at the air inlet of said gas-to-gas-heat-exchanger, wherein the heat of the hot gases is transferred to said air, thereby cooling the hot gases and heating said combustion air for the reactor which exits said heat exchanger through the hot-air-blast outlet duct and is delivered to the reactor;

a pressure control point located in the charge duct just above the concentric inlet;

a reference pressure control point at the atmosphere end of the charge duct;

a means for connecting the pressure control points with tubing lines and an electronic differential pressure sensor transmitter;

a means for connecting the electric output of said electronic-differential-pressure-sensor-transmitter to an electronic controller, said controller controlling the suction delivered by the suction fan and servo valve;

a calibration set point is built into the electronic controller;

wherein said method comprises:

loading the solid materials into the charge duct;

forming a concentric inlet with the charge duct; said inlet connecting the reactor with the plenum forming a bellow-charge-gas-off-take;

settling the coarse solid particulate and depositing the coarse particulate in a plurality of outside containers;

exhausting the gases with the plenum-outlet-duct after being cleaned of coarse particulate to the heat exchanger;

delivering the hot air blast to the reactor for combustion through the hot air blast outlet;

controlling the flow of the exhaust gas by the servo valve to prevent the escape of exhaust gases uncontrollably into the atmosphere;

modulating the suction delivered from the suction fan and the servo valve for supplying the necessary energy to force the exhaust gas to follow the gas route instead of exhausting through the charge duct by the electronic controller;

said method capable of being applied for charging into reactors selected from a group consisting of vertical reactors, ovens, chemical reactors, cupolas, ferrous and non-ferrous blast furnaces and shaft furnaces in the absence of locks, conventional flap valves, gates, pressure chambers, doors and bells.

2. The method according to claim 1, wherein when the process changes to a different operating condition, the change is sensed; said method comprising:

measuring the differential static pressures of the control points in the charge duct provided that when the difference in static pressure is changed to a standard 4 to 20 mA proportional current signal which is the input to the electronic controller, the differential static pressure is compared with the calibration set point;

delivering either a positive or negative DC voltage to open or close the servo valve; such that when the differential static pressure control point is different from the reference pressure control point, the servo valve will begin to move in the correct direction, until the pressures are equal;

maintaining the differential static pressure close to zero between the control points and the charge duct at all operating conditions such that the gas or air flow in the charge duct is maintained close to zero;

adjusting the offset to concurrently prevent exhaust gases from escaping to the atmosphere and prevent air infiltration into the exhaust gases.

3. The method according to claim 1, further comprising loading the solid charge materials into the reactor at all times, while simultaneously preventing the loss of gases to the atmosphere and intake of air into the gases by maintaining a condition of no-flow of gases in the charge duct at all operating conditions.

4. The method according to claim 1, wherein the exhaust gas contains substantial amount of combustible gases selected from a group consisting of carbon monoxide, hydrogen, hydrocarbons or mixtures thereof.

5. The method according to claim 4, wherein the device assembly further comprises:

a pilot burner at the inlet of the plenum outlet duct which connects the plenum to the heat exchanger; said burner lit at all times;

a temperature sensor, located at the other end of plenum outlet duct, before the heat exchanger;

a temperature transmitter receiving the signal from the temperature sensor where the said signal is transformed to a 4–20 mA standard signal;

a servo-valve controller, connected to the servo valve;

a temperature proportional controller receiving the standard signal by means of an adjustable set-point; said controller overriding the pressure proportional controller at a specific temperature and automatically modulating the servo-valve by increasing or decreasing the incoming air flow to regulate the previously selected working temperature;

a priority selector connected upstream to the temperature controller and downstream to the servo-valve controller; said selector having a range adjustment and together with the temperature controller override the pressure proportional controller;

wherein said method comprises:

conducting a controlled post combustion by the reaction between the air and the combustible gases prior to introduction of the gases into the heat exchanger;

allowing a sufficient amount of air infiltration by using the servo-valve in order to maintain the temperature of the gases at the selected set points;

controlling the working temperature of the heat exchanger by sending a signal to the servo valve controller;

delivering either a positive or negative DC voltage to open or close the servo valve.

6. The method according to claim 5, wherein the temperature controller overrides the pressure controller at a temperature within a range of from 100° C. to 500° C.

7. The method according to claim 6, wherein the range adjustment of the priority-selector is at a temperature of from 400° C. to 800° C.

* * * * *